US006695269B1

(12) United States Patent
Anscher

(10) Patent No.: US 6,695,269 B1
(45) Date of Patent: Feb. 24, 2004

(54) MULTI-PURPOSE ATTACHMENT DEVICE

(75) Inventor: Joseph Anscher, Muttontown, NY (US)

(73) Assignee: National Molding Corp., Farmingdale, NY (US)

( * ) Notice: Subject to any disclaimer, the term of this patent is extended or adjusted under 35 U.S.C. 154(b) by 0 days.

(21) Appl. No.: 09/665,020

(22) Filed: Sep. 19, 2000

Related U.S. Application Data

(63) Continuation-in-part of application No. 09/216,680, filed on Dec. 18, 1998, now abandoned.

(51) Int. Cl.[7] ..... A47B 96/00

(52) U.S. Cl. ..... 248/225.11; 248/222.11; 248/223.41; 224/269; 224/673

(58) Field of Search ..... 248/221.11, 221.12, 248/222.12, 222.13, 222.11, 223.31, 223.41, 225.11; 24/198, 200, 197, 165, 172, 316, 315, 319, 321; 224/575, 197, 199, 271, 272, 268, 247, 248, 901, 650, 673; 362/108, 102

(56) References Cited

U.S. PATENT DOCUMENTS

| | | | | |
|---|---|---|---|---|
| 3,845,522 A | | 11/1974 | Soukeras | 24/74 A |
| 3,963,156 A | | 6/1976 | Perrin | 224/1 |
| 4,106,679 A | | 8/1978 | Hillinger | 224/26 B |
| 4,372,468 A | | 2/1983 | Harvey | 224/268 |
| 4,419,794 A | | 12/1983 | Horton | 24/667 |
| 5,014,892 A | | 5/1991 | Copeland | 224/271 |
| 5,038,985 A | | 8/1991 | Chapin | 224/252 |
| 5,054,170 A | | 10/1991 | Otrusina | 24/597 |
| 5,056,696 A | * | 10/1991 | Lahr | 224/148 |
| 5,097,997 A | | 3/1992 | Kipnis | 224/269 |
| 5,201,858 A | | 4/1993 | Otrusina | 24/597 |
| 5,232,137 A | | 8/1993 | Devine | 224/252 |
| 5,322,252 A | | 6/1994 | Puente | 248/221.4 |
| 5,604,958 A | | 2/1997 | Anscher | 24/3.1 |
| 5,651,522 A | | 7/1997 | Davis | 248/221.11 |
| 5,699,943 A | | 12/1997 | Schaefer | 224/197 |
| 5,850,954 A | | 12/1998 | Dong-Joo | 224/197 |
| 5,957,421 A | * | 9/1999 | Barbour | 248/220.21 |

* cited by examiner

*Primary Examiner*—Gwendolyn Baxter
(74) *Attorney, Agent, or Firm*—Collard & Roe, P.C.

(57) ABSTRACT

An attachment device for a strap comprises a base, bar for attaching the base to a shoulder strap of a backpack and a releasable catch mechanism for securing an implement holder. The implement holder is adapted to be releasably secured to the base via the releasable catch mechanism. The releasable catch mechanism comprises an upwardly extending side wall extending up from the top surface of the base and having an overhanging lip. A flexible arm is integrally formed with the base near the side wall and has a free end extending above the plane of the base. An abutting surface is located on the free end and abuts the implement holder when it is inserted under the overhanging lip. The implement holder comprises a plate, a holder portion attached to the top surface of the plate and an attachment portion extending from the bottom surface of the plate.

11 Claims, 10 Drawing Sheets

MULTI-PURPOSE ATTACHMENT DEVICE

This is a continuation-in-part of U.S. patent application Ser. No. 09/216,680 filed on Dec. 18, 1998 now abandoned.

BACKGROUND OF THE INVENTION

1. Field of the Invention

This invention relates to a multi-purpose attachment device for use on backpacks. In particular, this invention relates to a sliding device for attachment to backpacks and which can be coupled to several different attachment pieces for holding a variety of implements.

2. The Prior Art

Hikers and bicyclists often have the need to attach various implements to the outside of their backpacks. Articles such as flashlights, keys, hydration tubes, etc. are more conveniently carried in an easily accessible place on the backpack's shoulder straps than inside the backpack. This enables the user to reach the implements without having to remove the backpack. This is especially important with hydration tubes, which must be accessible while a cyclist is riding his bicycle.

There are several devices that clip to the shoulder straps of backpacks for holding hydration tubes or other implements, depending on the shape and configuration of the device. However, the user may have the need for different devices on different days, depending on the activity planned. Attaching several different devices to the shoulder strap would be inconvenient and unwieldy. Therefore, it would be desirable to have an attachment device for use on a backpack shoulder strap that can accommodate a variety of different implements.

SUMMARY OF THE INVENTION

It is therefore an object of the invention to provide an attachment device for a strap that can be used to hold a variety of different implements.

It is another object of the invention to provide an attachment device for a strap that can also be attached to a chest strap.

It is yet another object of the invention to provide an attachment device that is simple and inexpensive to manufacture.

These and other objects are accomplished by an attachment device for a strap, comprising a base, means for attaching the base to a shoulder strap of a backpack and a releasable catch mechanism for securing an implement holder. The invention further comprises at least one implement holder adapted to be releasably secured to the base via the releasable catch mechanism.

The means for attaching the base to a backpack comprises two arms disposed along opposite edges of the base. Each arm has a transverse slit therethrough for threading the base onto a strap. Preferably, the slits are offset from the center of each arm so that removal and attachment of the base to a strap is made easier.

There can also be two additional arms disposed on the other opposite edges of the base, so that all four edges of the base have an arm. All of the arms have a transverse slit therethrough, so that the base is securable on two perpendicular straps. This feature is particularly important if the backpack has both shoulder straps and a chest strap. This way, the attachment device can be secured on both the chest strap and shoulder strap and cannot slide around at all.

The releasable catch mechanism comprises an upwardly extending side wall extending up from the top surface of the base and having an overhanging lip. A flexible arm is integrally formed with the base and has a free end extending above the plane of the base. The flexible arm can have the free end extending either toward or away from the side wall, i.e., the origin of the flexible arm can be disposed either directly opposite or adjacent to the side wall. The free end of the flexible arm has an abutting surface that abuts the side of an implement holder that is inserted between the free end of the flexible arm and the side wall. The implement holder comprises a plate, a holder portion attached to the top surface of the plate and an attachment portion extending from the bottom surface of the plate. The attachment portion comprises an outwardly extending flange. The implement holder is coupled to the base by sliding the flange over the flexible arm and inserting the flange underneath the overhanging lip. The flexible arm exerts upward pressure on the flange and forces it against the lip to hold it in place. The abutting surface on the flexible arm prevents backward sliding of the implement holder and prevents any inadvertent removal of the implement holder. The implement holder is removed by depressing the flexible arm so that the implement holder clears the abutting surface. To keep the implement holder from sliding out from the lip, the side wall and overhanging lip are preferably U-shaped.

The abutting surface can be formed from a protrusion located on the flexible arm. The protrusion abuts the flange and prevents backward movement of the implement holder.

The implement holder can take many forms and can have an infinite number of variations, depending on the function for which it is used. One variation is a hydration tube holder comprising a plate and a flexible S-shaped arm attached at one end to the plate. A hydration tube is held in place by sliding the tube between the plate and the arm. The curve of the S on the arm prevents the tube from escaping.

Another variation is a flashlight holder comprised of a plate and a flexible C-shaped holder element attached at its center to the plate. A flashlight can be snapped into the C-shaped holder element and held there by the friction of the holder element. Another possibility is a D-ring pivotally attached to a plate. Preferably, the base is supplied with several implement holders so that a user can choose which implement holder to use each day.

In an alternative embodiment, the releasable catch mechanism comprises a circular wall with an inwardly overhanging lip. The implement holder comprises a plate having a top surface and a bottom surface, a holding portion attached to the top surface of the plate and two flexible bayonet catches extending from the bottom surface of the plate. The implement holder is attached to the base by inserting the bayonet catches within the circular wall such that they catch on the lip and secure the implement holder to the base.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
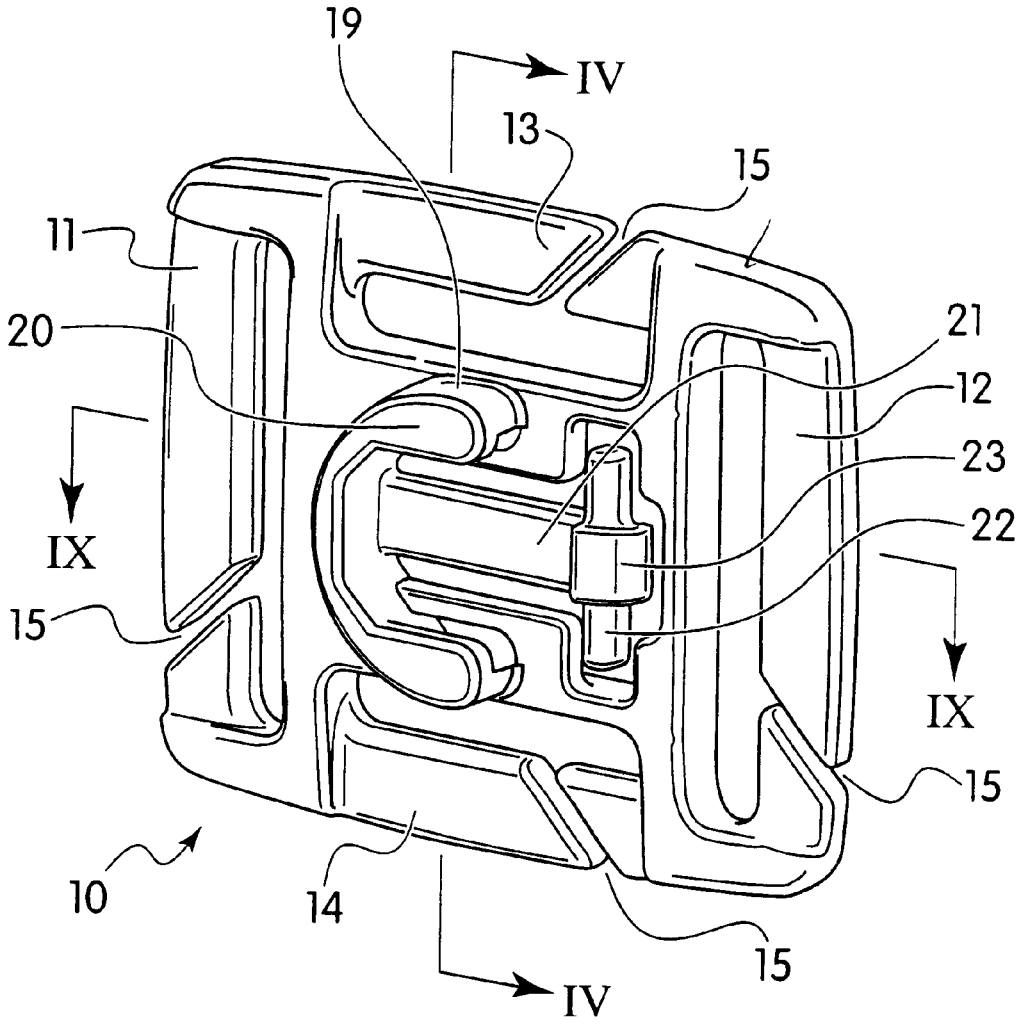
FIG. 1 shows a perspective view of the base of the attachment device according to the invention.
Figure 2:
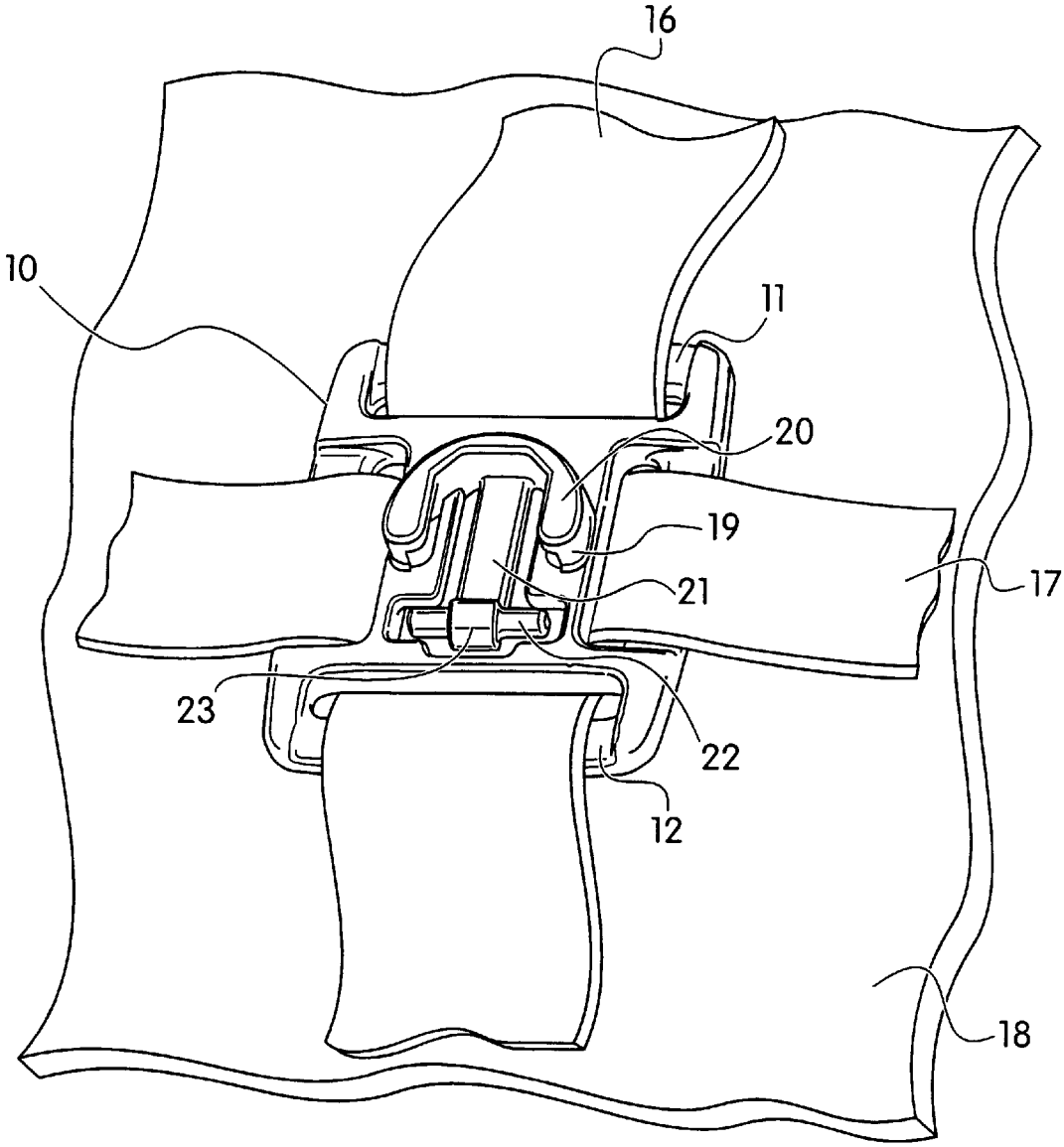
FIG. 2 shows the base as attached to shoulder and chest straps of a backpack.

Referring now in detail to the drawings and, in particular, FIG. 1, there is shown the base 10 according to the invention, to which a variety of implement holders can be attached. Base 10 is an integrally molded one-piece design having four bars 11, 12, 13 and 14 for attaching base 10 to one or more straps. Each of bars 11, 12, 13, 14 has a transverse slit 15 therein to allow straps 16, 17 of a backpack 18 or other item to be easily threaded through base 10, as shown in FIG. 2.

The mechanism for attaching an implement to base 10 comprises a semicircular wall 19 having an overhanging lip 20, and a flexible arm 21, which has a free end extending away from wall 19. The free end of flexible arm 21 extends slightly above the top surface of base 10 to place upward pressure on an implement holder mounted within base 10, as explained below. Arm 21 has a transverse bar 22 extending across the free end of arm 21, and a protrusion 23 at the free end of arm 21. Protrusion 23 forms an abutting surface that prevents backward movement of an implement holder once the implement holder is inserted between the free end of arm 21 and wall 19. Transverse bar 21 and protrusion 23 keep an implement holder in place once it is inserted underneath lip 20, to lock the implement holder within base 10. To remove the implement holder, arm 21 must be depressed sufficiently so that the implement holder clears protrusion 23. Protrusion 23 also provides a convenient location for the user to press down on arm 21 to release implement holder as explained below.

Figure 3:
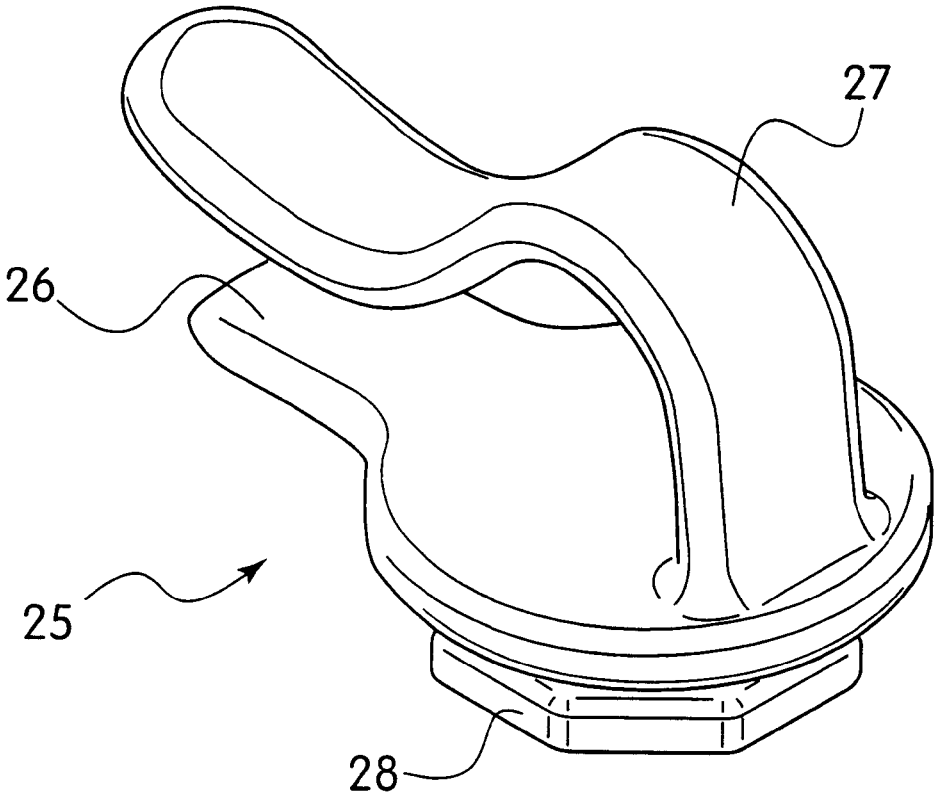
FIG. 3 shows a perspective view of a hydration tube holder for use with the base.

One example of a suitable implement holder is a hydration tube clip 25, which is shown in FIG. 3. Tube clip 25 comprises a plate 26 with a resilient S-shaped arm 27 mounted above plate 26. A hydration tube (not shown) is slid in between plate 26 and arm 27. The tube is preferably wider than the lower end of arm 27 so that it cannot escape once it is mounted between plate 26 and arm 27. Clip 25 is secured to base 10 via a hexagonal flange 28, which extends outwardly beneath plate 26.

Figure 4:
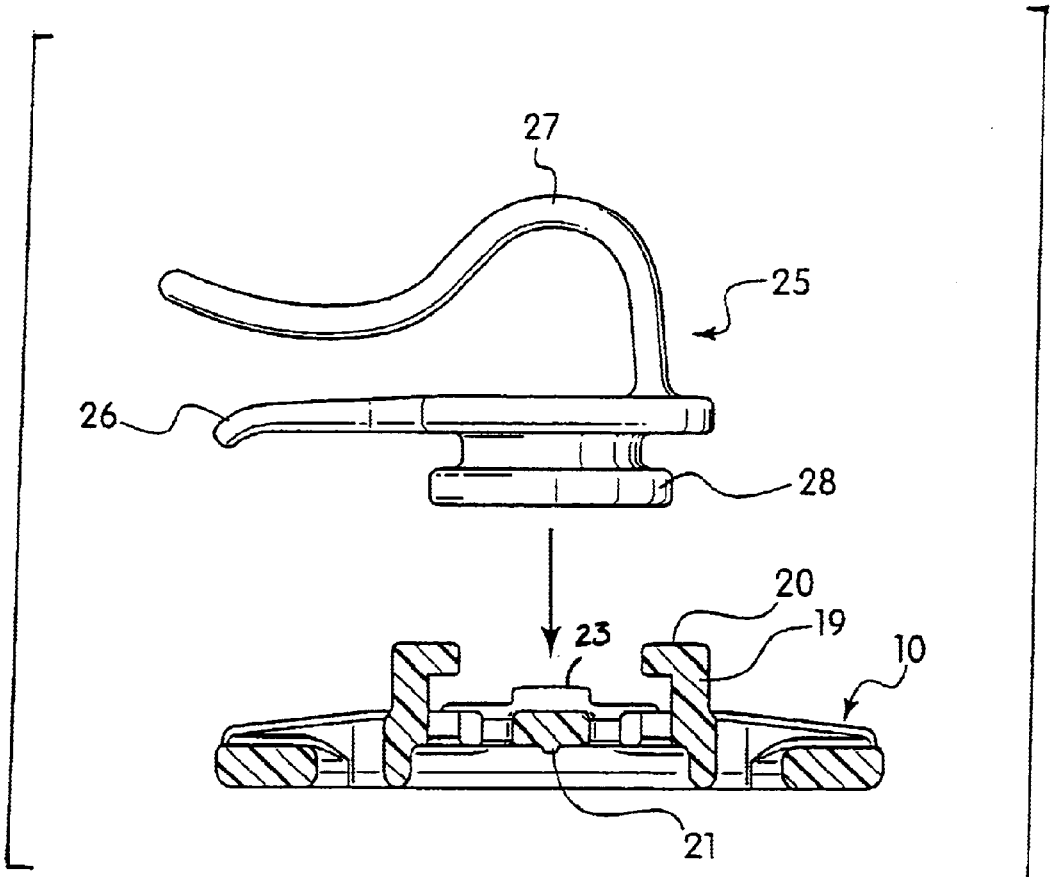
FIG. 4 shows a cross-sectional view of the hydration tube holder and the base along lines IV—IV of FIG. 1.
Figure 5:
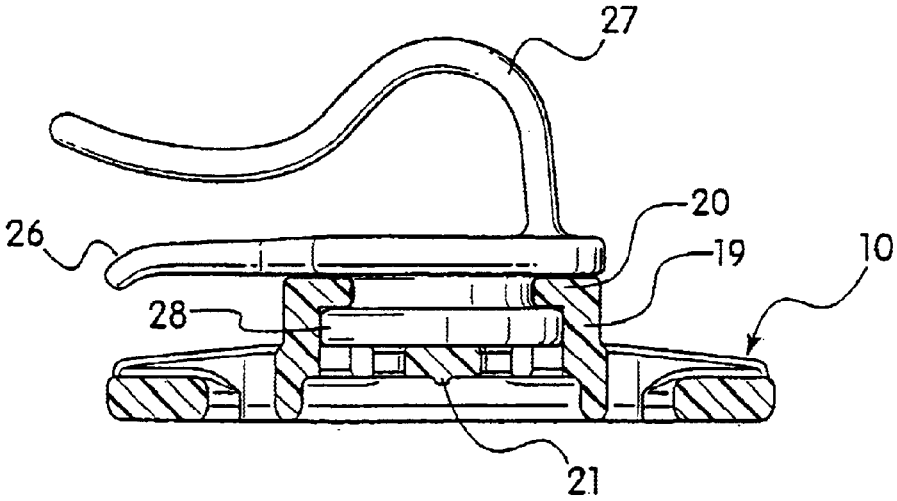
FIG. 5 shows a cross-sectional view of the hydration tube holder inserted into the base.

FIGS. 4 and 5 show the procedure for locking clip 25 into base 10. Flange 28 is slid underneath lip 20 and is pushed upward by arm 21 on base 10, to keep clip 25 locked within base 10. Protrusion 23 forms an abutting surface, that abuts flange 28 and prevents flange 28 from sliding out from underneath lip 20, thereby locking the clip 25 in place.

Figure 6:
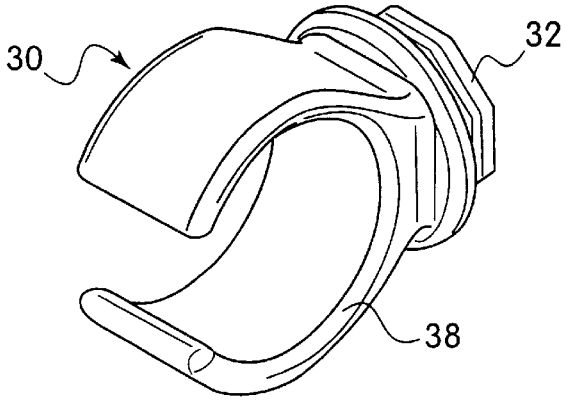
FIG. 6 shows a perspective view of the flashlight holder for use with the base according to the invention.
Figure 7:
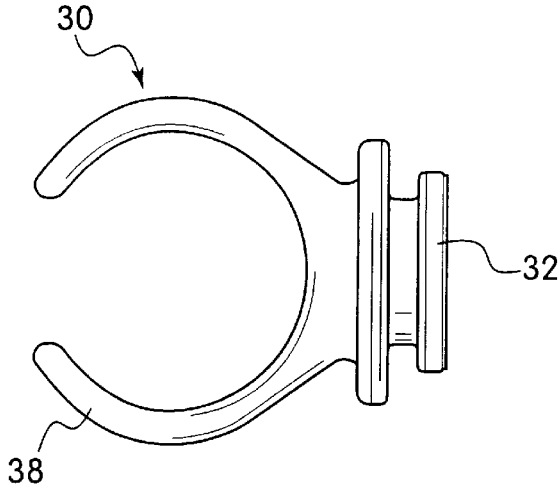
FIG. 7 shows a side view of the flashlight holder.
Figure 8:
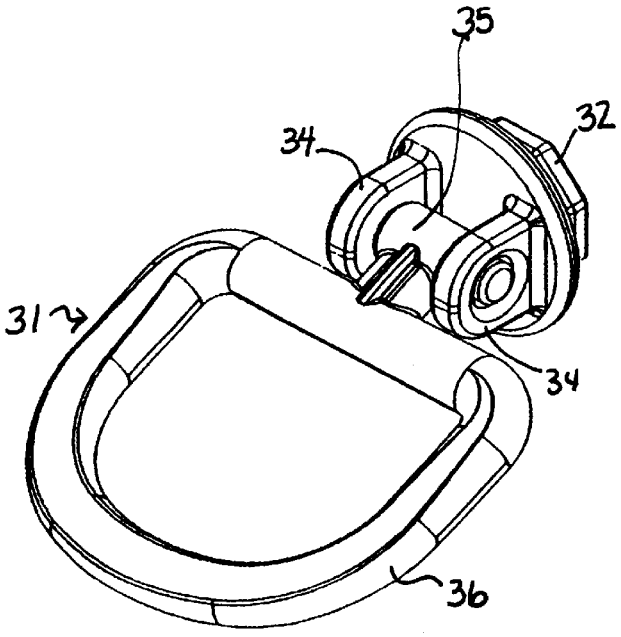
FIG. 8 shows a perspective view of a D-ring for use with the base.

Other suitable implement holders are a flashlight holder 30 or a D-ring 31, as shown in FIGS. 6–8. Flashlight holder 30 is held in place by a flange 32, similar to flange 28 on clip 25. Flashlight holder 30 has a C-shaped holding element 38 which functionally retains a flashlight therein. D-ring 31 is locked into base 10 is locked in a similar manner via flange 32. D-ring 31 is comprised of a ring portion 36 that is pivotally attached to flange 32 via a hinge 35 mounted in side brackets 34.

Figure 9:
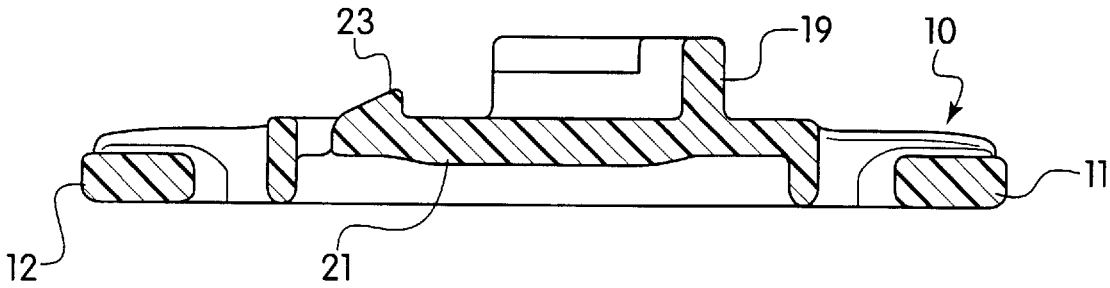
FIG. 9 shows a cross-sectional view of the base along lines IX—IX of FIG. 1.
Figure 10:
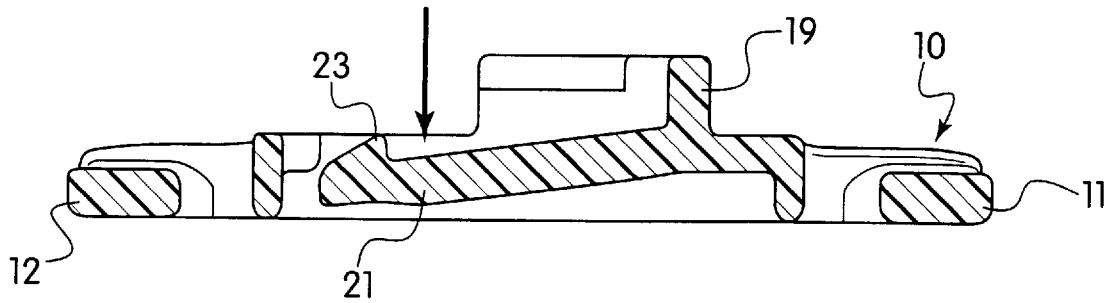
FIG. 10 shows a cross-sectional view of the base of FIG. 9 in a release position.

The various implement holders can be released from base 10 in a manner shown in FIGS. 9 and 10. The user merely presses downward on flexible arm 21 to create enough clearance over protrusion 23 to slide the implement holder out from base 10. This way, the implement holders are easily interchanged to accommodate the user's changing needs.

Figure 11:
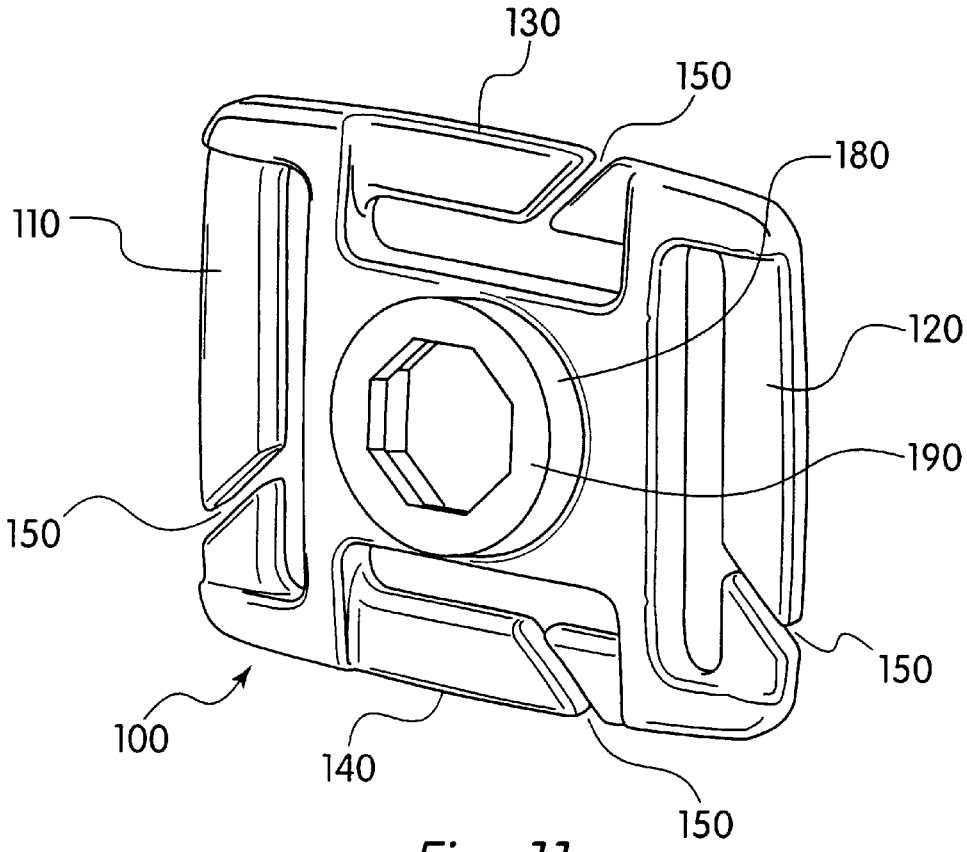
FIG. 11 shows a perspective view of an alternative embodiment of the base according to the invention.
Figure 12:
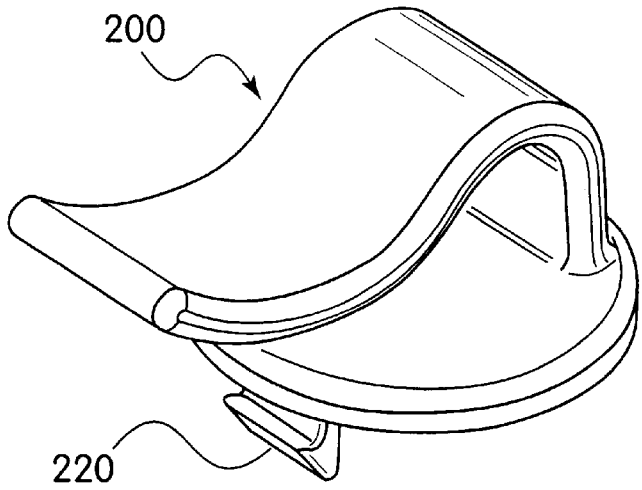
FIG. 12 shows a perspective view of an alternative embodiment of a hydration tube holder for use with the base shown in FIG. 11.
Figure 13:
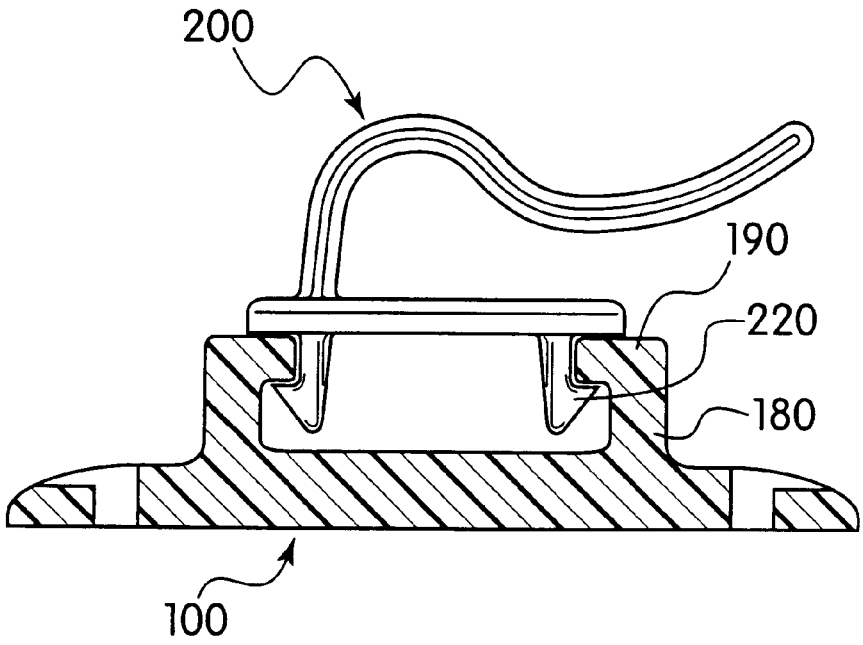
FIG. 13 shows a side cross-sectional view of the hydration tube holder of FIG. 12 inserted in the base of FIG. 11.

An alternative embodiment of the invention is shown in FIGS. 11–13. In this embodiment, Base 100 as shown in FIG. 11 has bars 110, 120, 130 and 140, each having a transverse slit 150 for attaching base 100 to a strap in a similar way as that shown in FIG. 2. Base 100 is also equipped with a circular vertical wall 180, which has an inwardly overhanging lip 190, for locking an implement holder within base 100.

A suitable implement holder is shown in FIG. 12 in the form of a hydration tube clip 200. Tube clip 200 has two bayonet catches 220 mounted underneath clip 200. Bayonet catches 220 lock into lip 190 when clip 200 is pushed into base 100, as shown in FIG. 13. Any suitable implement holder having bayonet-type catches could be used with base 100. In addition, any alternative locking mechanism could be used to latch onto base 100 could also be used.

Figure 14:
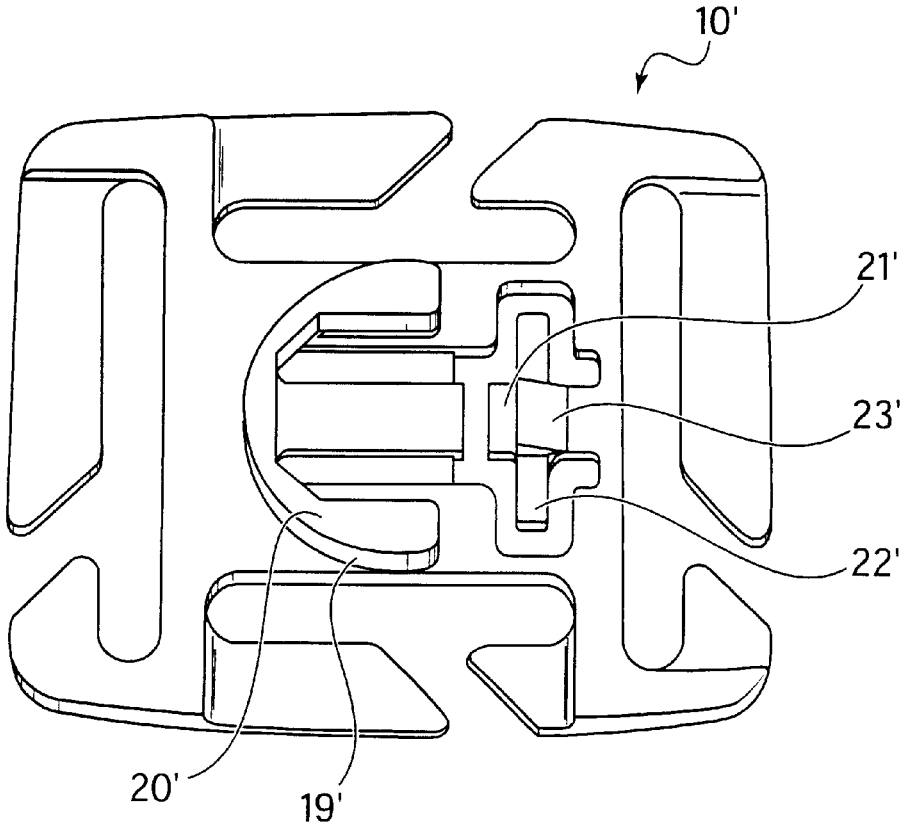
FIG. 14 shows a top perspective view of another embodiment of the base of the attachment device.
Figure 15A:
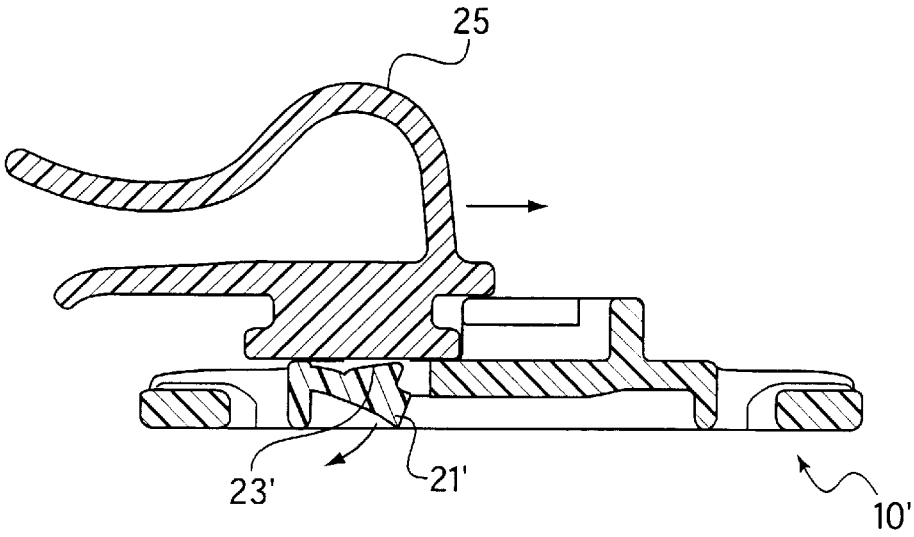
FIGS. 15*a* and 15*b* show a side cross sectional view of the hydration tube holder of FIG. 3 inserted in the base of FIG. 14.
Figure 15B:
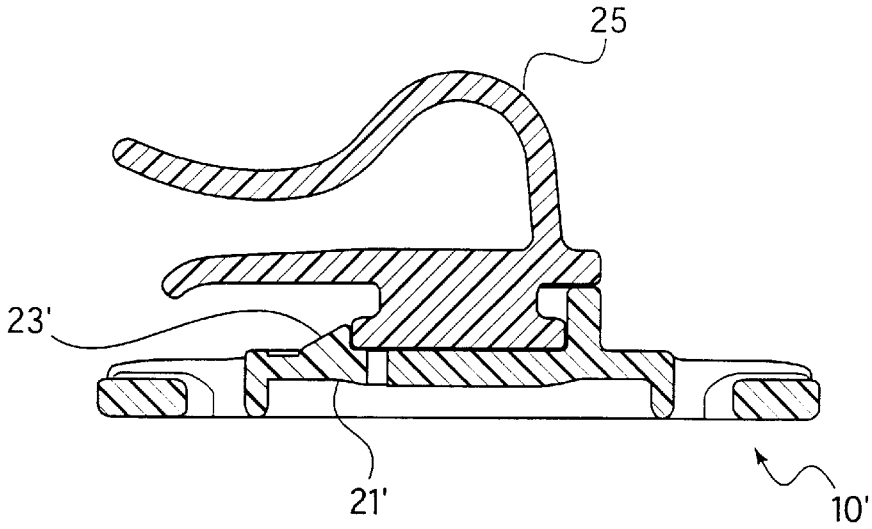

Another embodiment is shown in FIGS. 14, 15*a* and 15*b*. In this case, base 10' comprises a semicircular wall 19' having an overhanging lip 20'. A flexible arm 21' having a free end is mounted opposite wall 19' and extends towards wall 19'. The free end of flexible arm 21' extends slightly above the top surface of base 10' to place upward pressure on an implement holder 25 mounted within base 10', as explained below. Arm 21' has a transverse bar 22' extending across the free end of arm 21', and a protrusion 23' at the free end of arm 21'. Protrusion 23' forms an abutting surface against implement holder 25 and keeps implement holder 25 in place once it is inserted underneath lip 20', to lock implement holder 25 within base 10'. Implement holder 25 slides over arm 21' and protrusion 23' to fit underneath lip 20'. Lip 20' prevents movement in one direction, while protrusion 23' prevents movement in the other direction, so implement holder 25 is locked in place.

To release the implement holder, the user presses down on protrusion 23', thereby allowing the implement holder sufficient clearance to slide out of lip 20' over protrusion 23' and arm 21'.

Accordingly, while only a few embodiments of the present invention have been shown and described, it is obvious that many changes and modifications may be made thereunto without departing from the spirit and scope of the invention.

What is claimed is:

1. An attachment device for a strap, comprising:

a base having a front surface, a rear surface and four edges and comprising:

two arms disposed along opposite edges of said base, each arm having a transverse slit therethrough for threading said base onto a strap;

two additional arms disposed on opposite edges of said base, so that all four edges of said base have an arm, said two additional arms each having a transverse slit therein, such that said base is securable on two perpendicular straps;

a releasable catch mechanism for securing an implement holder, comprising a side wall extending up from the top surface of said base and having an overhanging lip, and a flexible arm integrally formed with said base and extending above the plane of said base, said flexible arm having a free end with an abutting surface; and at least one implement holder releasably secured to the base between said abutting surface and said overhanging lip;

wherein the abutting surface on the flexible arm keeps the implement holder secured to the base underneath the overhanging lip to prevent any backward movement of the implement holder, and wherein pressing on the flexible arm causes the implement holder to clear the abutting surface to release the implement holder from the base.

2. The attachment device according to claim 1, wherein each slit is offset from the center of the arm.

3. The attachment device according to claim 1, wherein said slits on said additional arms are offset from the center.

4. The attachment device according to claim 1, wherein said flexible arm extends away from said side wall.

5. The attachment device according to claim 1, wherein said flexible arm extends towards said side wall.

6. The attachment device according to claim 1, wherein the implement holder comprises:

a plate having a top surface and a bottom surface, a holder portion attached to the top surface of the plate; and an attachment portion extending from the bottom surface of the plate, said attachment portion comprising an outwardly extending flange, wherein said implement holder is coupled to the base by inserting the flange underneath the overhanging lip and is held in place by the abutting surface on the flexible arm, and wherein said implement holder is released from the base by pressing on the flexible arm until the flange clears the abutting surface, and sliding the flange out from the lip.

7. The attachment device according to claim 1, wherein the side wall and overhanging lip are semicircular.

8. The attachment device according to claim 1, wherein the implement holder is a hydration tube holder comprising a plate and a flexible S-shaped arm attached at one end to the plate.

9. The attachment device according to claim 1, wherein the implement holder is a flashlight holder comprised of a plate and a flexible C-shaped holder element attached at its center to the plate.

10. The attachment device according to claim 1, wherein the implement holder is a D-ring.

11. The attachment device according to claim 1, wherein the abutting surface comprises a protrusion on the free end of the flexible arm.

* * * * *